United States Patent [19]

Lane

[11] Patent Number: 4,503,974

[45] Date of Patent: Mar. 12, 1985

[54] ALBUM WITH REMOVABLE PAGES AND ENCLOSURE

[76] Inventor: Barry Lane, 2225 McMullen Booth Rd., Clearwater, Fla. 33519

[21] Appl. No.: 535,764

[22] Filed: Sep. 26, 1983

[51] Int. Cl.[3] ..... B65D 85/00

[52] U.S. Cl. ..... 206/457; 206/315.1; 206/472; 206/232; 229/8

[58] Field of Search ..... 206/449, 457, 232, 472, 206/315.1; 229/8

[56] References Cited

U.S. PATENT DOCUMENTS

| | | | |
|---|---|---|---|
| 2,427,318 | 9/1947 | Warren | 206/315.1 |
| 2,732,842 | 1/1956 | Loudon . | |
| 2,797,806 | 7/1957 | Davis | 206/457 |
| 3,199,895 | 8/1965 | De Tullio | 229/8 |
| 3,504,915 | 4/1970 | Walker | 206/315.1 |
| 3,570,071 | 3/1971 | Wardell . | |
| 3,641,684 | 2/1972 | Paige | 206/232 |
| 3,717,816 | 2/1973 | White . | |
| 3,752,503 | 8/1973 | Holes et al. . | |
| 4,302,013 | 11/1981 | Kavis | 206/315.1 |

FOREIGN PATENT DOCUMENTS

| | | | |
|---|---|---|---|
| 905374 | 12/1945 | France | 206/472 |

*Primary Examiner*—William T. Dixson, Jr.
*Attorney, Agent, or Firm*—Stefan Stein

[57] ABSTRACT

An album for receiving a plurality of removable pages. The album comprises a front and back cover interconnected by a binder member. Preferably, the pages comprise sheets of jigsaw puzzles having removable puzzle pieces. An enclosure is incorporated onto the inside of the back cover of the album for receiving the puzzle pieces removed from the pages. A strap, connected to the binder, is provided for positioning around the enclosure and the pages when the album is closed.

8 Claims, 6 Drawing Figures

ALBUM WITH REMOVABLE PAGES AND ENCLOSURE

BACKGROUND OF THE INVENTION

1. Field of the Invention

This invention relates to albums. More particularly, this invention relates to albums which contain a plurality of removable pages and an enclosure for storing articles within the album.

2. Description of the Prior Art

Presently there exist many types of albums designed to retain a plurality of pages for viewing by the consumer. In other types of albums, the pages are removable to allow distribution of the pages among several viewers to facilitate viewing by each such viewer. In many cases, the individual pages of these albums typically include artistic renderings or representations which are designed to attract the interest of the consumer viewing the same.

For example, U.S. Pat. Nos. 3,570,071 issued to Wardell and 3,752,503 issued to Holes et al., illustrate an album in which the individual pages are removably secured to the binder of the album. More specifically, each of these patents teaches the concept of providing one or more clips which are inserted about the inward edge of the page and a fastening means for releasibly fastening the clipped page to the binder of the album. In the patent to Wardell, the fastening means comprises a spike which is inserted into a resilient pad affixed to the binder. In the Holes et al. patent, the clip includes hinge engaging elements which releasibly engage into a plurality of hinge retaining elements.

U.S. Pat. No. 3,715,816 issued to White teaches an amusement book for children including pages containing animal representations and pockets for releasibly receiving natural food representations for insertion therein. Unfortunately, the pages containing the animal representations are not removable from the binder of the album, thereby permitting only one child at a time to play with the various pages of the album. Furthermore, although there is illustrated in the patent a pocket for receiving the animal food representation, it is clear no means are provided to store the animal representations during play or during non-use, except for the particular pocket designed to receive a specific animal food representation. Obviously, this requires a child to finish playing the game by inserting the respective animal food representations into their respective pockets.

Therefore, it is an object of this invention to provide an apparatus which overcomes the aforementioned inadequacies of the prior art devices and provides an improvement which is a significant contribution to the advancement of the album art.

Another object of this invention is to provide an album containing pages which are releasibly secured to the binding of the album to permit the addition or subtraction of pages to the album and to permit each page to be passed around among a number of viewers to permit each page, after removal, to be viewed by a single viewer.

Another object of this invention is to provide an album including a plurality of pages for receiving discernible objects such as jigsaw puzzle pieces, photographic slides, photographic negatives, and photographs.

Another object of this invention is to provide an album including an enclosure for receiving the discernible objects and for storing such objects.

Another object of this invention is to provide an album including a plurality of pages composed of a jigsaw puzzle, with removable individual puzzle pieces, for arrangement and affixation to the puzzle.

Another object of this invention is to provide an album including jigsaw puzzle pages and an enclosure for storing the individual pieces of the puzzle during play and during non-use.

Another object of this invention is to provide an album having a plurality of pages and an enclosure with means for preventing the pages from entering into the interior area of the enclosure.

Another object of this invention is to provide an album having a plurality of pages and an enclosure, with a strap for encircling the outer, peripheral edge of the pages and the enclosure to retain the album in a closed position and to protect the outer, peripheral edges of the pages and the enclosure from damage during non-use.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention comprises an album having a plurality of pages removably secured therein. The album comprises a front and a back cover interconnected by a binding. The plurality of pages are preferably removably secured to the binding by means of a two-component continuous, flexible fastener such as the fastener sold under the registered trademark "Velcro". When utilizing the Velcro brand fastener, one component of the fastener is rigidly secured to the binding and the other component is rigidly secured to the inward edge of each of the pages. This permits the pages to be fastened within the album to be subsequently removed during use.

Preferably, the pages comprise jigsaw puzzles having removable puzzle pieces similar to conventional jigsaw puzzles. Additionally, one or more of the pages may include a jigsaw puzzle on both sides thereof. The jigsaw puzzle design of the pages may include any shape or configuration depending on the particular type of customers to which the album of the invention is to be sold. For example, the jigsaw puzzles may include designs fanciful or educational to children when the album is intended to be sold in the children's top industry.

An enclosure is provided on the back cover of the album to store the individual pieces of the puzzle when the player of the jigsaw puzzle is attempting to reassemble the puzzle pieces into their proper position on the page. The enclosure also functions to store the individual puzzle pieces between playing periods. Specifically, when the player is interrupted in the reassembly of the puzzle, the individual puzzle pieces may be placed into the enclosure and the album closed whereupon the puzzle pieces are conveniently stored in the enclosure until the next playing session.

A strap is provided for positioning about the enclosure and the peripheral edges of the pages. Preferably, the strap is fixedly connected at one end to the binder and includes a fastener at the other end for removably fastening to the other portion of the binder. When fastened into position, the strap functions to protect the edges of the pages in the enclosure and to retain the album in its closed position, thereby assuring that the individual jigsaw puzzle pieces stored within the enclosure will not be lost therefrom during non-use.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
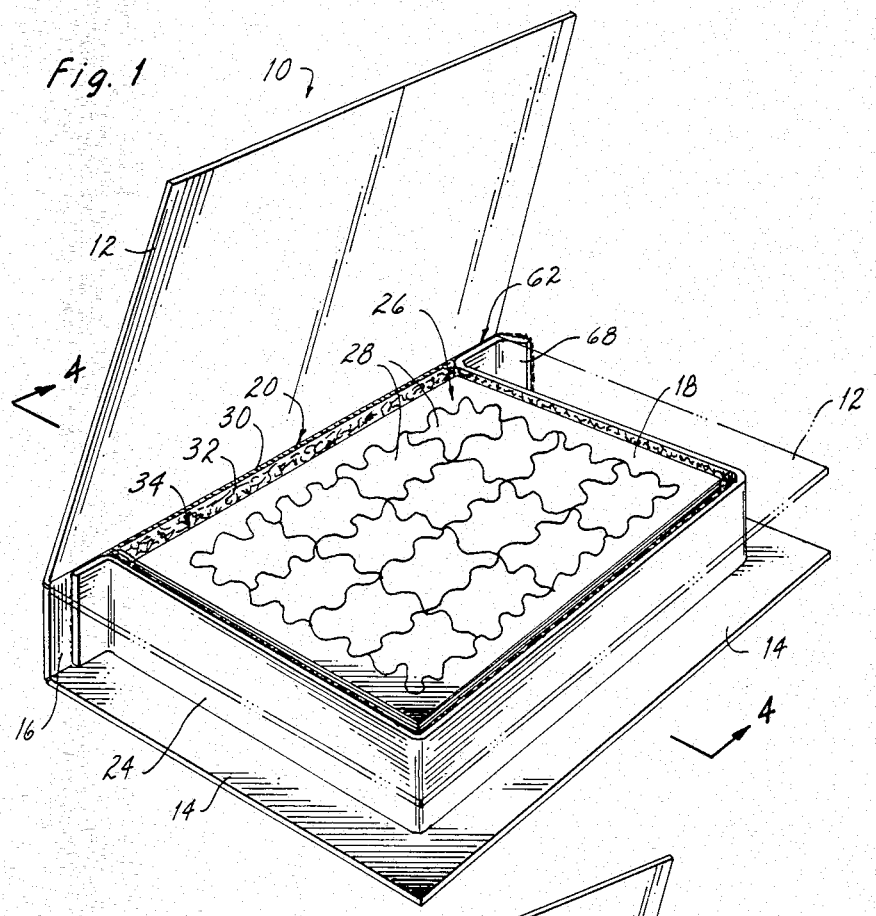
FIG. 1 is a perspective view of the album of the invention illustrating the pages thereof resting on the upper edges of the enclosure with the strap positioned thereabout.

FIG. 1 is a perspective view of the album 10 of the invention which comprises a front cover 12 and a back cover 14 pivotable interconnected by means of a binder member 16. The album 10 further comprises a plurality of pull-out pages 18 which are removably fastened to the binder member 16 by means of a fastener, generally indicated by the numeral 20. An enclosure, generally indicated by the numeral 22, is affixed to one of the covers 12 or 14, preferably the back cover 14. Finally, a strap 24 is provided for positioning about the edges of the pull-out pages 18 and the enclosure 22.

Figure 2:
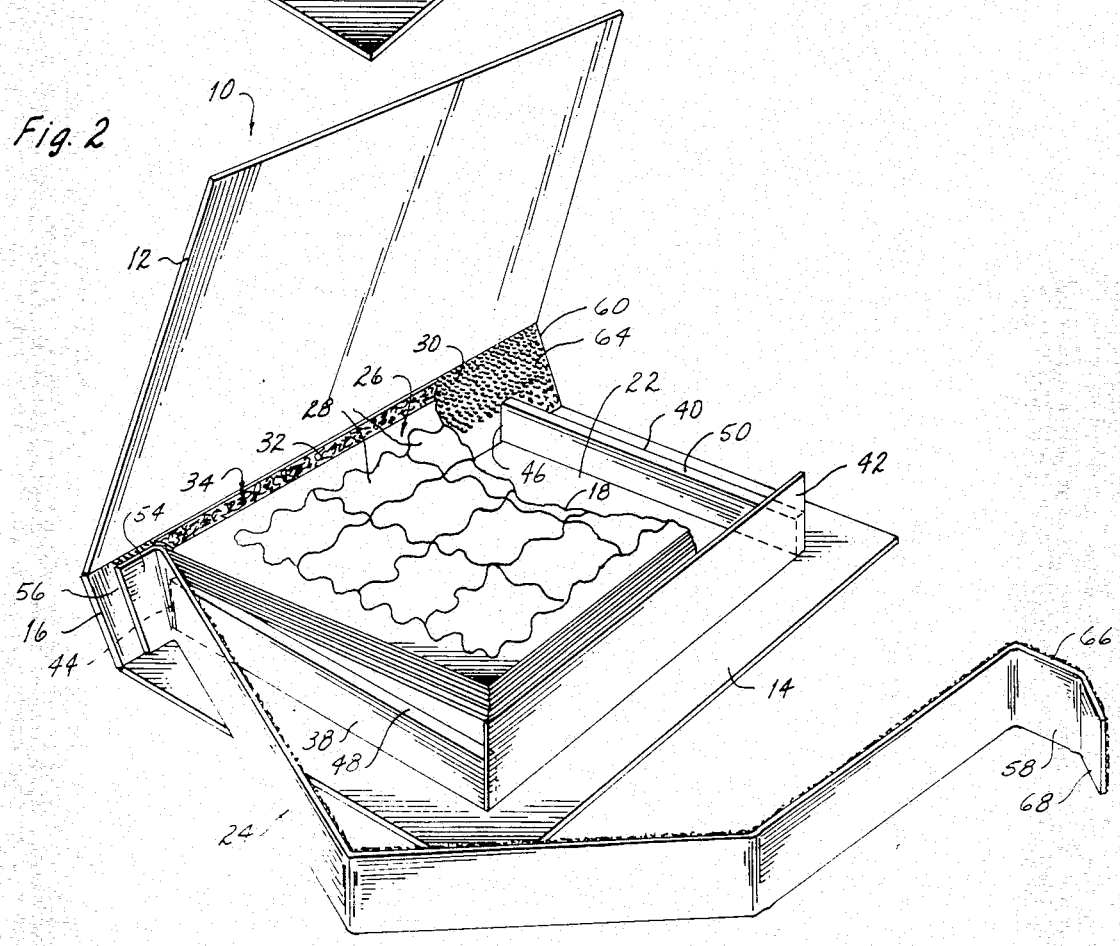
FIG. 2 is a perspective view of the album of the invention in a partially opened position illustrating the strap removed from its secured position about the peripheral edges of the pages and the enclosure.

FIG. 2 is another perspective view of the album 10 of the invention illustrating the strap 24 unfastened from the binder member 16 to allow the binder member 16 of the album 10 to pivot away from its closed, perpendicular position with respect to the back cover 14. In this position, the viewer of the album 10 is allowed to view the individual pull-out pages 18 by fanning the pages 18 in a conventional manner.

Figure 3:
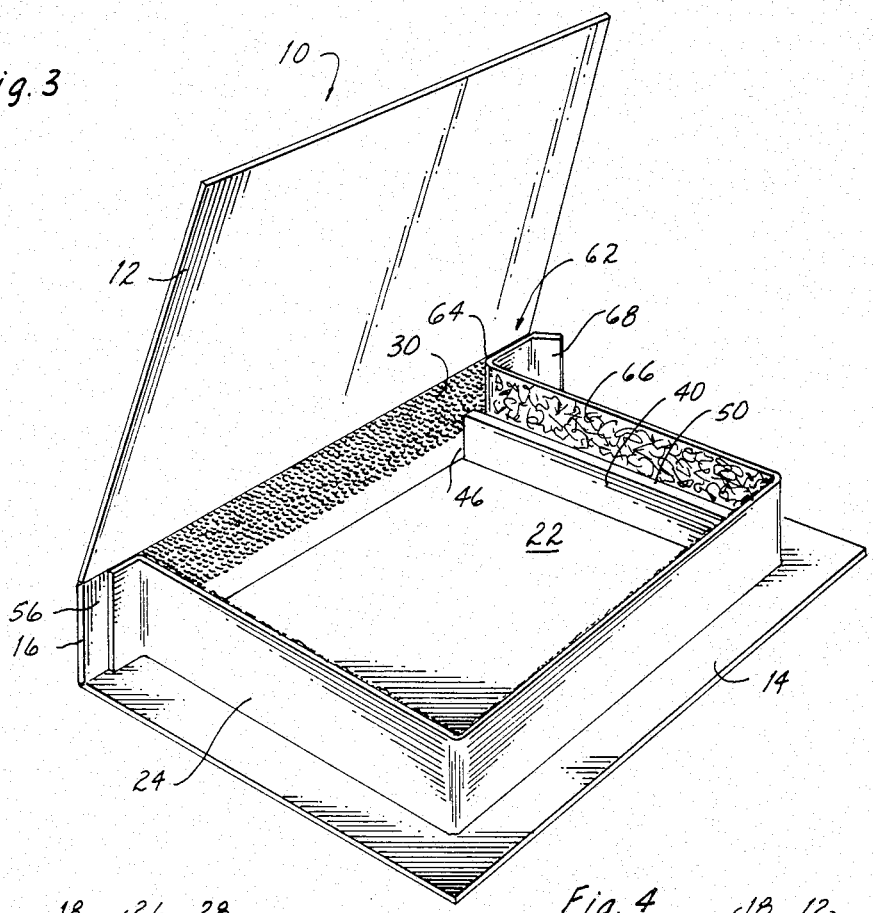
FIG. 3 is a perspective view of the album of the invention with the pages removed illustrating the tray formed by the enclosure for retaining the individual jigsaw puzzle pieces therein.

FIG. 3 illustrates the album 10 of the invention with the pull-out pages 18 removed therefrom allowing the enclosure 22 to act as a tray for receiving discernible objects, as hereinafter more fully described.

Figure 5:
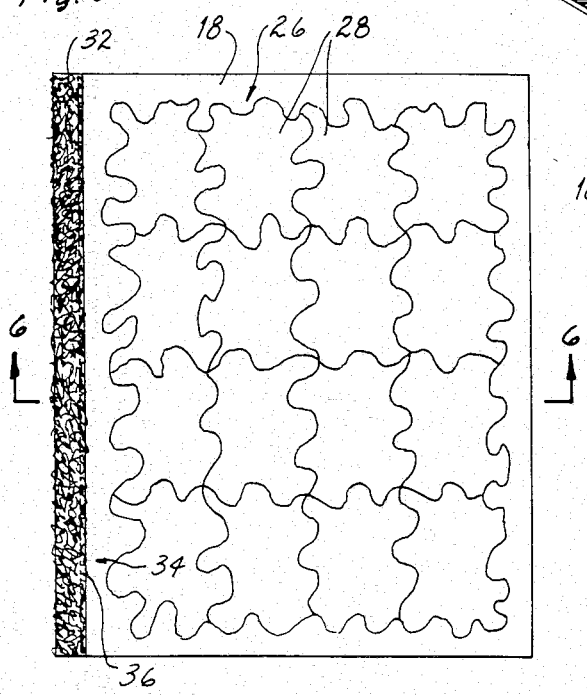
FIG. 5 is a plan view of a typical page having an arbitrary jigsaw puzzle design.
Figure 4:
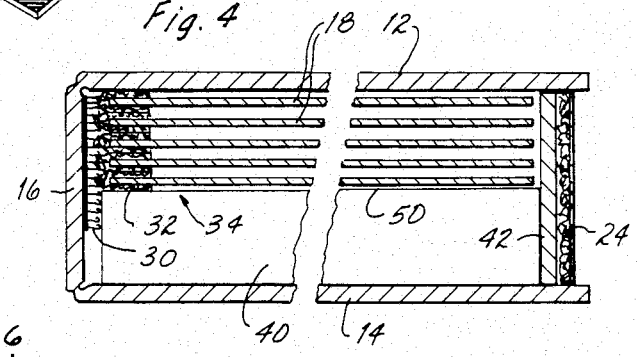
FIG. 4 is a cross-sectional view of FIG. 1 along lines 4—4 illustrating the manner in which the pages are seated above the tray of the enclosure when the album is in a closed position.
Figure 6:
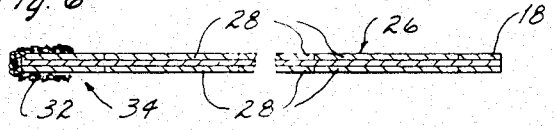
FIG. 6 is a cross-sectional view of FIG. 5 along lines 6—6 illustrating the manner in which one component of the fastener is connected about the rearward edge of the page.

More particularly, referring to FIGS. 4, 5 and 6, in conjunction with the perspective views of FIGS. 1–3, it is seen that each pull-out page 18 preferably comprises a jigsaw puzzle 26 having a plurality of discernible puzzle pieces 28 which are removable from the jigsaw puzzle 26 of the page 18 in a manner substantially identical to conventional jigsaw puzzles. As noted earlier, the pull-out pages 18 are removably fastened to the binder member 16 by means of a fastener 20. Preferably, the fastener 20 comprises a two component fastener having one component 30 connected to the binder member 16 and the other component 32 connected to the inward edge 34 of each of the pull-out pages 18. In its preferred embodiment, the two component fastener 20 comprises a fastener commonly sold under the registered trademark "Velcro" in which each of the components 30 and 32 comprise a flexible, fabric-like material which removably fastens together. When utilizing this preferred embodiment of the fastener 20, one component 30 is sewn or otherwise securely affixed to the binder member 16 along the length thereof substantially equal to the height of the pages 18. Likewise, the other component 32 of the fastener 20 is preferably folded about the inward edge 34 of the page 18 and rigidly secured thereto by glueing or stitching 36. During use, each of the pages 18 may be individually removably fastened to the binder member 16 by merely placing the inward edge 34 of the page 18 containing the component 32 in contact with the component 30 attached to the binder member 16. Once fastened, the pull-out pages 18 may be easily removed from the binder member 16 by merely pulling on the page 18 until the components 30 and 32 of the fastener 20 release one another.

Without departing from the spirit and scope of this invention, it is noted that the preferred embodiment of the fastener 20 illustrated in the drawings and described herein, is only one particular embodiment of a fastener 20 which may be utilized in conjunction with the album 10 of the invention. Accordingly, many other two-component fasteners 20 coming within the scope of the claims appended hereto, may be utilized in conjunction with the album 10.

As noted earlier, enclosure 22 of the album 10 is preferably fastened to the back cover 14 of the album 10. Referring to FIGS. 1–4, it is seen that the preferred embodiment of the enclosure 22 comprises a lower wall 38, upper wall 40 and a front wall 42 which are connected at right angles to form a rectangular enclosure open at the inward side facing the binder member 16.

Preferably, however, the inward edges 44 and 46 of the lower and upper walls 38 and 40, respectively, are positioned immediately adjacent to the binder member 16 such that the binder member 16 forms the inward side of the enclosure 22 to form a boxed-in tray.

In a more preferred embodiment of the enclosure 22, the pull-out pages 18 are prevented from entering the tray of the enclosure 22 by dimensioning the distance between the lower and upper walls 38 and 40, respectively, to be appreciably less than the height of the pages 18. In this manner, the upper and lower portions of the bottommost page 18 may rest upon the edges 48 and 50 of the lower and upper walls 38 and 40, respectively. Similarly, front wall 42 may also be positioned sufficiently inward to support the front edges of the bottommost page 18. However, in its preferred embodiment, front wall 42 comprises an extended width which is sufficient to extend beyond the enclosure 22 to the front cover 12. In this preferred embodiment, the front wall 42 functions to not only define the tray of the enclosure 22, but also to provide a support for the front cover 12 to prevent overclosing of the album 10 resulting in crushing the pages 18 and the enclosure 22. Further, the front wall 42 functions to protect the front edge of the pages 18. With the preferred embodiment of the enclosure 22 discussed above, it is apparent that the component 30 of the fastener 20 need only extend across the width of the binder member 16, as illustrated in FIG. 3, to the plane formed by the edges 48 and 50 of the lower and upper walls 38 and 40.

The strap 24, briefly discussed above, preferably comprises an elongated configuration having a width substantially equal to the width of the preferred embodiment of the front wall 42. Further, the lower end 54 of the strap 24 is preferably permanently affixed to the lower portion 56 of the binder member 16 such as by glueing or stitching. The other, upper end 58 of the strap 24 is preferably removably fastened to the upper portion 60 of the binder member 16 by means of a two-component fastener 62, with one component 64 connected to the upper portion 60 of the binder member 16 and the other component 66 fastened to the upper end 58 of the strap 24. Although many fasteners may suffice, the preferred embodiment of the fastener 62 comprises the two-component fastener under the registered trademark "Velcro". In this preferred embodiment of the fastener 62, the component 64 affixed to the binder member 16 may comprise one component of the "Velcro"-brand fastener which is sewn or otherwise affixed to the binder member 16. For convenience, this component 64 may comprise an extension of component 30 of faster 20 previously described. The entire strap 24 may comprise the other component 66 of the fastener 62. The upper end 58 of the strap 24 may include a tab 68 extending beyond the binder member 16 to facilitate unfastening the fastener 62 and removal of the strap 24 about the enclosure 22.

The strap 24 functions to retain the album 10 in a closed position in which the binder member 16 is retained in a position substantially perpendicular to the back cover 14. Thus, the strap 24 may be utilized as illustrated in FIG. 1, to retain the album 10 in its closed position during non-use. Alternatively, strap 24 may be used to retain the binder member 16 in a position vertical to the back cover 14 to define the tray of the enclosure 22.

From the foregoing description, it is noted that the album 10 of the invention is particularly suited to contain a plurality of jigsaw puzzle pages 18 for use by children and other persons. When used as such, it is noted that the individual pages 18 may be individually removed from the album 10 by releasing fastener 20 to be played with individually by children. During play, the individual puzzle pieces 28 may be stored within the enclosure 22. Furthermore, should play be interrupted, the individual puzzle pieces 28 may be stored within the enclosure 22 and the jigsaw puzzle pages 18 re-fastened to the binder member 16 and the album 10 closed for use at a later time. Obviously, when utilized in this manner, the enclosure 22 functions to store the individual puzzle pieces 28 thereby lessening the likelihood that such pieces 28 will be lost between playing periods.

It is also noted that the album 10 of the invention is particularly suited to contain many other discernible objects. For example, each of the pull-out pages 18 may include a plurality of slots, made from a transparent plastic, to receive photographic objects such as slides, photographs and/or negatives. In this regard, the enclosure 22 would function to store the photographic objects which have not been organized and placed in the slots in the pull-out pages 18.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be restored to without departing from the spirit of the invention.

Now that the invention has been described,

What is claimed is:

1. An album, comprising in combination:

a front cover;

a back cover;

a binder member interconnecting said front cover and said back cover to permit said album to open and close to and from an opened position and a closed position;

a plurality of pages;

an enclosure connected to one of said front cover and said back cover, said enclosure comprising an interconnected lower wall, upper wall, and front wall forming a tray, the rearward ends of said lower wall and said upper wall being positioned substantially adjacent to said binder whereby said binder defines a rearward wall of said enclosure to further form said tray;

means for retaining said pages away from the interior area of the tray of said enclosure when said album is in said closed position; and a strap connected to said binder for positioning about said enclosure when said album is in said closed position.

2. The album as set forth in claim 1, wherein said retaining means is formed by positioning said upper wall and said lower wall of said enclosure apart a distance appreciably less than the height of said pages, whereby said pages rest on the edges of said upper and lower walls when said album is in said closed position.

3. The album as set forth in claim 1, wherein a first end of said strap is fixedly connected to said binder member and wherein a second end of said strap is removably connected to said binder member thereby permitting said strap to be removably secured about said enclosure when said album is in said closed position.

4. The album as set forth in claim 3, wherein said front wall of said enclosure includes an extended width sufficient to extend over the front edges of said pages when said album is in said closed position.

5. The album as set forth in claim 4, further including means for removably securing said pages to said binder member.

6. The album as set forth in claim 5, wherein said removable securing means comprises a two component fastener, one component of said fastener connected to said binder member and the other component of said fastener connected to the inward edge of said pages.

7. The album as set forth in claim 6, wherein at least one of said pages comprises a jigsaw puzzle on one side thereof having removable puzzle pieces.

8. The album as set forth in claim 7, wherein said page comprising a jigsaw puzzle further includes a jigsaw puzzle on the other side thereof having removable puzzle pieces.

* * * * *